US008149651B2

(12) United States Patent
Meier et al.

(10) Patent No.: US 8,149,651 B2
(45) Date of Patent: Apr. 3, 2012

(54) RESONATOR MOUNTED IN A CASE INCORPORATING A WATCH MODULE

(75) Inventors: Thomas Meier, Altendorf (CH); Fabien Blondeau, Le Landeron (CH); André Zanetta, Neuchâtel (CH); Emmanuel Fleury, Moutier (CH); Silvio Dalla Piazza, St. Imier (CH); Pierre-André Meister, Bienne (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 12/377,826

(22) PCT Filed: Aug. 14, 2007

(86) PCT No.: PCT/EP2007/007172

§ 371 (c)(1),
(2), (4) Date: Jun. 14, 2010

(87) PCT Pub. No.: WO2008/019819

PCT Pub. Date: Feb. 21, 2008

(65) Prior Publication Data

US 2010/0246340 A1 Sep. 30, 2010

(30) Foreign Application Priority Data

Aug. 14, 2007 (EP) ..... 06118973

(51) Int. Cl.
*G04F 1/04* (2006.01)

(52) U.S. Cl. ..... 368/159; 368/187

(58) Field of Classification Search ..... 368/159, 368/187

See application file for complete search history.

(56) References Cited

U.S. PATENT DOCUMENTS

| | | | | |
|---|---|---|---|---|
| 3,909,639 | A * | 9/1975 | Kawai et al. | 310/344 |
| 3,969,640 | A | 7/1976 | Staudte | |
| 4,133,169 | A * | 1/1979 | Scherrer et al. | 368/87 |
| 4,176,517 | A * | 12/1979 | Yoshida | 368/201 |
| 4,763,309 | A | 8/1988 | Descombes | |
| 7,387,433 | B2 * | 6/2008 | Hung | 368/299 |

FOREIGN PATENT DOCUMENTS

| | | |
|---|---|---|
| EP | 0 253 227 A1 | 1/1988 |
| FR | 2 283 478 | 3/1976 |
| GB | 1 581 917 | 12/1980 |

OTHER PUBLICATIONS

International Search Report issued in corresponding application No. PCT/EP2007/007172, completed Nov. 5, 2007 and mailed Nov. 15, 2007.

* cited by examiner

*Primary Examiner* — Sean Kayes
(74) *Attorney, Agent, or Firm* — Griffin & Szipl, P.C.

(57) ABSTRACT

The invention concerns an electronic watch comprising an electric motor (5) for driving analogue display means (6), and a time base (1, 2) comprising an oscillator circuit (2) and a resonator (1), both mounted in the same case (9), characterized in that said case further comprises a control circuit (4) for said electric motor.

12 Claims, 2 Drawing Sheets

Fig. 1
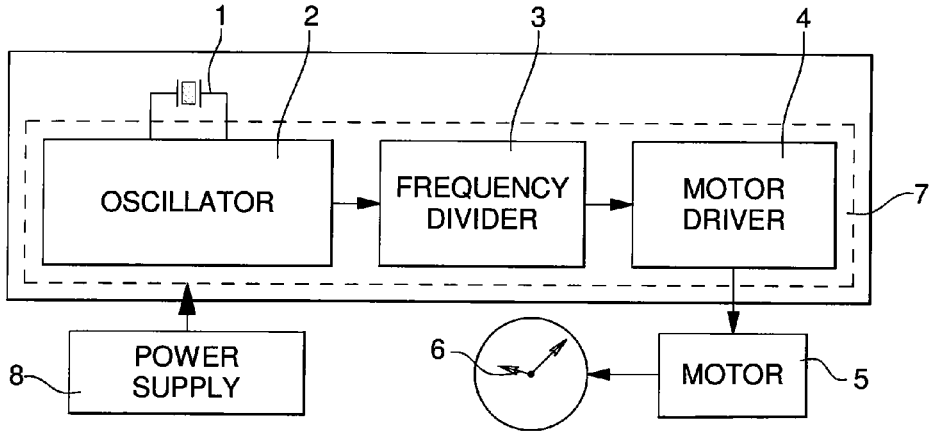
Fig. 2
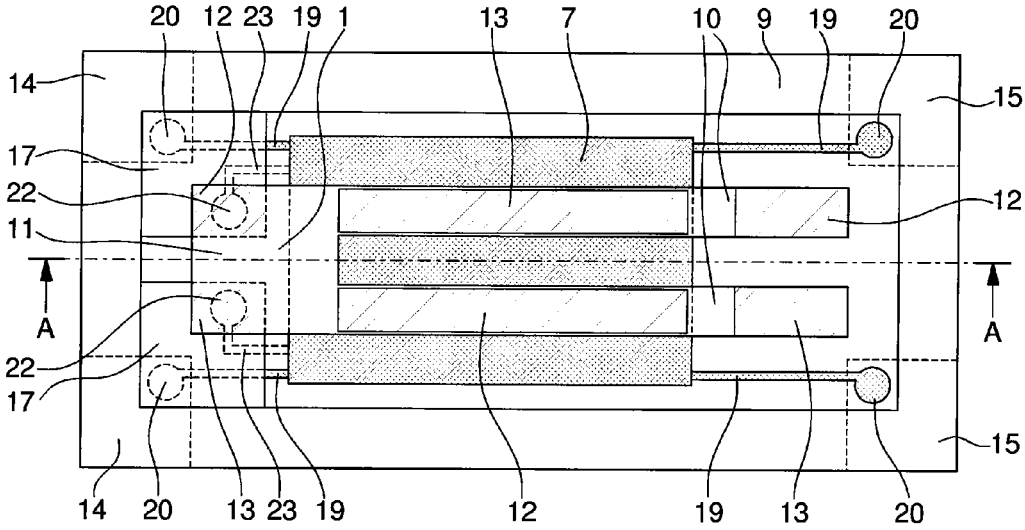
Fig. 3 Cut A-A
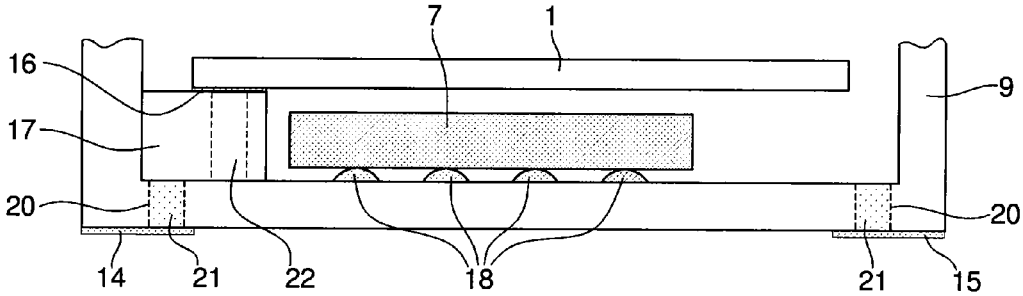

RESONATOR MOUNTED IN A CASE INCORPORATING A WATCH MODULE

This is a National Phase Application in the United States of International Patent Application No. PCT/EP2007/007172 filed Aug. 14, 2007, which claims priority on European Patent Application No. 06118973.4, filed Aug. 16, 2006. The entire disclosures of the above patent applications are hereby incorporated by reference.

FIELD OF THE INVENTION

The present invention concerns, generally, a resonator mounted in a case, and more particularly, the incorporation in this case of additional electronic components. Such resonators are used in numerous applications and more particularly in the field of watch making and telephony.

BACKGROUND OF THE INVENTION

A quartz resonator in the form of a tuning fork associated with an oscillator to form a time base is known from the prior art. In order to reduce the place occupied by such a time base, for example for the integration thereof in a portable electronic device, it is known to mount the tuning fork shaped quartz resonator and the integrated circuit comprising the oscillator in the same case.

Although these prior solutions reduce the volume occupied by the time base, it has been shown, more specifically within the field of horology, that the available space remains insufficient to make a timepiece of small dimensions. Indeed, electronic watches comprise a certain number of additional electronic elements that require a second integrated circuit external to that of the oscillator incorporated in the piezoelectric resonator case. The necessity of having two integrated circuits and thus two substrates or equivalent for carrying these integrated circuits involves occupying a lot of the available space in the watch, which means increasing the volume of the latter in an excessive and, therefore, undesirable manner; for obvious aesthetic reasons.

SUMMARY OF THE INVENTION

It is one of the main objects of the present invention to overcome the aforementioned drawbacks. The invention concerns an electronic watch comprising an electric motor (5) for driving analogue display means (6), and a time base (1, 2) comprising an oscillator circuit (2) and a resonator (1), both mounted in the same case (9), characterized in that the case further comprises a control circuit (4) for the electric motor.

The present invention therefore concerns an electronic watch according to a first illustrative embodiment, which pertains to an electronic watch comprising a case containing an electric motor for driving analogue display means and an additional inner case, wherein a time base including an oscillator circuit and a resonator are both mounted in the additional inner case, wherein the inner case further includes a control circuit for the electric motor. Indeed, an electronic analogue display watch includes a motor for driving the analogue display, for example hands, so as to display time information provided by the time base and transmitted to the motor by means of the control means thereof. This is why the electric motor control means of the watch are, within the scope of the present invention, advantageously integrated in the same circuit as the oscillator in the resonator case. This solution also has the advantage of reducing the length of the connections between the electronic elements of the watch and thereby reducing, to the same extent, the sensitivity of the oscillator to external interference. This reduction in interference thus allows the watch to work at high impedance, more sensitive to such interference, and thus reduces the general power consumption of the electronic circuits of the watch while preserving an acceptable degree of immunity to disturbances.

Advantageous embodiments form the subject of additional illustrative embodiments of the invention. For example, in accordance with a second illustrative embodiment of the present invention, the first illustrative embodiment is modified so that the inner case includes four connection points, two of which are used for powering the oscillator circuit and the electric motor control circuit, wherein the two other connection points are used for controlling the electric motor. In accordance with a third illustrative embodiment of the present invention, the first illustrative embodiment or the second illustrative embodiment is further modified so that the oscillator circuit and the electric motor control circuit are integrated in the same integrated circuit. In accordance with a fourth illustrative embodiment of the present invention, the third illustrative embodiment is further modified so that the integrated circuit includes a frequency divider circuit arranged between the output of the oscillator circuit and the input of the electric motor control circuit for providing control signals at a desired motor control frequency. In accordance with a fifth illustrative embodiment of the present invention, the first illustrative embodiment is modified so that it further includes an external control member acting on one of the two motor control connection points to interrupt the electric motor control. In accordance with a sixth illustrative embodiment of the present invention, the first illustrative embodiment is modified so that the resonator case includes a glass cover and wherein the resonator frequency is adjusted by laser through the glass cover.

BRIEF DESCRIPTION OF THE DRAWINGS

Other features and advantages of the present invention will appear more clearly upon reading the following detailed description of embodiments of the invention made with reference to the annexed drawings and given by way of non-limiting example in which:

FIG. 1 is a schematic view of an electronic watch with an analog display according to one embodiment of the invention;

FIG. 2 is a view through the top of a case containing the time base and the motor control circuit;

FIG. 3 is a cross-section along the line A-A of FIG. 2; and

DETAILED DESCRIPTION OF THE INVENTION

Figure 4:
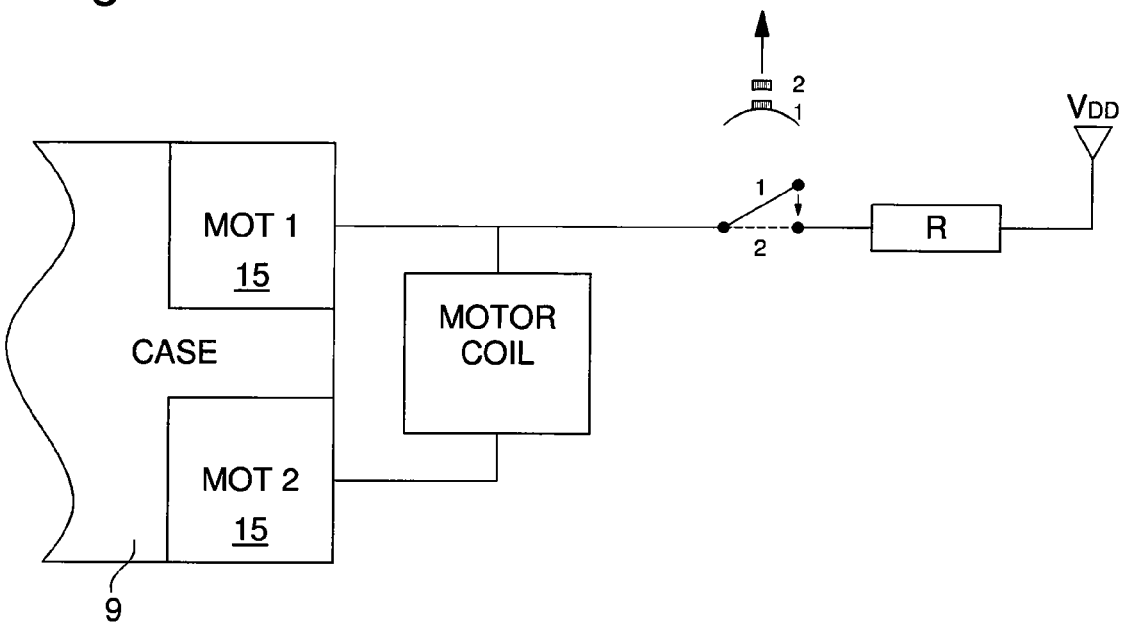
FIG. 4 is a schematic view an advantageous embodiment of the present invention.

In accordance with a first embodiment of the invention shown schematically in FIG. 1, the invention concerns an electronic watch comprising a time base formed for example by a piezoelectric resonator, such as a quartz resonator 1, or even a MEMS type silicon resonator connected to the terminals of an oscillator 2 whose output is connected to a frequency divider circuit 3 to obtain the working frequency desired for the watch so as to indicate the precise time. The output of frequency divider circuit 3 is connected to a control circuit 4 for an electric motor 5 for driving the gear trains, not shown here, rotating the analogue display means, such as hands 6 for providing the time indication, i.e. the hours, minutes and possibly seconds. One could for example use a stepping motor, in a conventional manner, also called a bipolar motor, formed of a magnetised rotor, a stator with high magnetic permeability to form the magnetic circuit loop and at least one coil whose function, when it is switched on, is to create a magnetic field in the stator which is thus converted into a magnet whose polarity depends upon the direction of current in the coil. Thus, the control circuit 4 of the motor provides a current that flows in the coil. The motor is controlled by a succession of positive and negative pulses spaced by a power-interruption. However, one could, of course, use another type of motor, such as, for example, a two-phase stepping motor in order to obtain a two-directional motor allowing the time of the watch to be set in the forward and backward direction.

Advantageously, as is shown in FIG. 1, oscillator 2, frequency divider circuit 3 and electric motor control circuit 4 are all integrated in a single integrated circuit 7 in order to reduce the space occupied by the electronic watch components and to reduce the electromagnetic interference in these electronic elements largely due to the length of the "wired" connections between elements. It will also be noted that this allows the number of external connections to be reduced to only four instead of eight in normal time. In fact, two connection terminals are normally provided for exciting the resonator, two more for connection to the integrated circuit, two more for powering the integrated circuit and finally two for controlling the motor. Here, only four terminals are necessary outside the case, the two power terminals of the integrated circuit and the two integrated circuit connection terminals, which are also used as motor control terminals. The two excitation terminals between the resonator and the integrated circuit are arranged only inside the case. One could nonetheless use several integrated circuits arranged beside each other without however fully benefiting from the aforementioned advantages. Integrated circuit 7 is powered by a power source 8 of the watch.

The main idea consists here in further reducing the space occupied by the electronic circuits of the watch. In order to do so, integrated circuit(s) 7, is advantageously arranged in the same case 9 already used for casing the piezoelectric resonator 1 inside the watchcase. The arrangement of integrated circuit 7 in resonator case 9 not only optimises the space occupied by all of these elements inside the watchcase, but also increases the protection of the integrated circuits against any external interference owing to the very short connection paths between the various elements inside resonator case 9. An example arrangement of these elements inside resonator case 9 is given in conjunction with FIGS. 2 and 3.

The numerical references of the elements common to FIGS. 1, 2 and 3 are identical. FIG. 2 is a top view of case 9 containing piezoelectric resonator 1 and an integrated circuit 7 comprising the electronic elements of the watch. It will be noted that in FIG. 2, the case is generally made of parallelepiped shaped ceramic material comprising a main part with a bottom and sides, and a cover, (not shown) for hermetically sealing case 9, for example by vacuum welding or any other appropriate means to obtain a hermetic assembly. It will be noted that, advantageously, the cover is made of glass so as to allow the resonator frequency to be precisely adjusted by laser once the case has been hermetically sealed, which has the advantage of avoiding the difficult-to-implement functions of oscillator inhibition or fine adjustment conventionally provided prior to closing the case in order to adjust the resonator frequency.

As can be seen in FIG. 2, piezoelectric resonator 1 and integrated circuit 7 are mounted in the main part of the case. The resonator is preferably a quartz resonator in the form of a tuning fork whose base 11 and vibrating arms 10 comprise metallized portions which form two groups of electrodes 12 and 13 allowing to subject the arms to electric fields in order to make the them vibrate. The connections between resonator 1 and integrated circuit 7 are preferably made by means of holes 22 formed in the steps 17 and are filled with a conductive adhesive, or any other appropriate conductive material, ensuring the connection with the conductive paths.

Again considering FIG. 2, under case 9, there are four connection terminals 14 and 15, connected on the one hand to the exterior of the case and, on the other hand, to the interior of the case. Inside the case, these four connection terminals are connected to integrated circuit 7. Outside the case, the two connection terminals 14 are connected to the power source, shown in FIG. 1, in order to power integrated circuit 7, and the two other connection terminals 15 are connected to the terminals of the electrical motor coil, to provide the coil with positive and negative electric pulses. It will be noted that the connections proposed are proposed only by way of non-limiting example and that likewise, by way of alternative, it is enough for two terminals of the four terminals 14 and 15 to be connected to the power source, on the one hand, and the two other remaining terminals to be connected to the motor coil on the other hand. The use of these four connection terminals 14 and 15 for, on the one hand powering the integrated circuit, and on the other hand, for controlling the motor via the motor control circuit integrated in integrated circuit 7 provides a simple and compact solution via the use of a single case 9 comprising the time base and the motor control circuit, and it is efficient since it is robust against various electromagnetic interference.

FIG. 3 is a median and longitudinal cross-section along the line A-A of FIG. 2. As can be seen in FIG. 3, resonator 1 is mounted by welding or bonding with a conductive adhesive the connection pads of the two groups of electrodes 12 and 13 located on the base of the resonator with corresponding conductive pads 16 provided on steps 17 of the bottom of case 9 for positioning resonator 1 above integrated circuit 7 arranged in the bottom of case 9. As already mentioned in relation to FIG. 2, the connection pads located on the base of resonator 1 can be connected to the integrated circuit 7 for exciting the electrodes and causing the resonator to vibrate, via conductive pads 16 connected to holes 22 formed in steps 17 and filled with an appropriate conductive material, and then via conductive paths 23 (see FIG. 2) themselves connected to integrated circuit 7. These connection means (16, 22, 23) have the advantage, on the one hand, of being very short and, on the other hand, of reaching the bottom surface of integrated circuit 7, namely the surface that receives the connections. It will be noted however that other suitable solutions could be envisaged by those skilled in the art.

The connection between the integrated circuit and the exterior of the case can be achieved as shown in FIGS. 2 and 3. In fact, in this example, connections studs 18 are provided, advantageously located underneath integrated circuit 7 connected to connection terminals 14 and 15 via conductive paths of pads 19 (see FIG. 2) and holes 20 passing through the bottom of case 9 and filled with a conductive adhesive 21 or any other appropriate conductive material. As these holes are located opposite connection terminals 14 and 15, the conductive adhesive provides the electrical connection with the inside of the case.

FIG. 4 shows a particularly advantageous embodiment according to the present invention. As in the preceding embodiment, there is a connection between connection terminals 15 MOT1 and MOT2 of case 9, corresponding to the output terminals of the motor control circuit, and the motor coil to allow transmission of the positive and negative electrical pulses via one or other of the connection terminals, which ensures the proper working of the hands and thus the time indication for the watch. Moreover, in this advantageous embodiment, one of the connection terminals, for example MOT1 for transmitting positive pulses, is also connected to a switch activated by an external control member of the watch. Activating this switch blocks the motor control and thus interrupts the time indication. This interruption is necessary to allow the time of the watch to be reset. Preferably, the external control member used is the stem-crown. Thus, as for a mechanical watch, the user only has to pull out the stem-crown from the pushed-in position 1 to the pulled-out position 2 in order to interrupt the time indication mechanism, the switch passing from its open position (position 1) to its closed position (position 2). One of the advantages is that when the crown is pulled out, the switch is then conductive and the motor steps are stopped which allows connection terminal MOT1 to be shared without any difficulty and the connection arrangement to be further reduced, insofar as the two functions, of controlling the motor on the one hand, and stopping the motor on the other hand, are temporally exclusive. Thus, a resistor can be provided on the side of the terminal of the switch connected to a reference potential to prevent any collision between the two functions or to control collisions in the integrated circuit, which avoids the use of the aforementioned resistor. Alternatively, the control member could be a push button or any other mechanism with two positions that can easily be activated by the user of the watch.

It will be clear that various alterations or improvements evident to those skilled in the art can be made to the various embodiments of the invention described in the present description, without departing from the scope of the invention defined by the annexed claims.

The invention claimed is:

1. An electronic watch comprising a watchcase in which are arranged an electric motor for driving analogue display means and a time base including an oscillator circuit and a resonator, wherein both the oscillator circuit and the resonator are mounted in an additional inner case disposed inside the watchcase, wherein the inner case further includes an electric motor control circuit for the electric motor and a plurality of connection points, wherein the plurality of connection points consist of a first connection point, a second connection point, a third connection point and a fourth connection point, wherein the first connection point and the second connection point are arranged for powering the oscillator circuit and the electric motor control circuit, and wherein the third connection point and the fourth connection point are arranged for controlling the electric motor.

2. An electronic watch comprising a watchcase in which are arranged an electric motor for driving analogue display means and a time base including an oscillator circuit and a resonator, wherein both the oscillator circuit and the resonator are mounted in an additional inner case disposed inside the watchcase, wherein the inner case further includes an electric motor control circuit for the electric motor and four connection points, two of which are arranged for powering the oscillator circuit and the electric motor control circuit, wherein the other two connection points are arranged for controlling the electric motor.

3. The electronic watch according to claim 2, wherein the oscillator circuit and the electric motor control circuit are integrated in the same integrated circuit.

4. The electronic watch according to claim 3, wherein the integrated circuit includes a frequency divider circuit arranged between an output of the oscillator circuit and an input of the electric motor control circuit for providing control signals at a desired motor control frequency.

5. The electronic watch according to claim 4, wherein the other two connection points arranged for controlling the electric motor include a first motor control connection point, and the watch further includes an external control member acting on the first motor control connection point that sends positive pulses to the electric motor to interrupt the electric motor control circuit.

6. The electronic watch according to claim 5, wherein the external control member is a crown.

7. The electronic watch according to claim 4, wherein the other two connection points arranged for controlling the electric motor include a first motor control connection point, and the watch further includes an external control member acting on the first motor control connection point that sends negative pulses to the electric motor to interrupt the electric motor control circuit.

8. The electronic watch according to claim 7, wherein the external control member is a crown.

9. The electronic watch according to claim 4, wherein the watch further includes an external control member disposed to act on the other two connection points that are arranged for controlling the electric motor, wherein the external control member is a crown.

10. The electronic watch according to claim 2, wherein the watch further includes an external control member acting on one of the two motor control connection points to interrupt the electric motor control circuit.

11. The electronic watch according to claim 10, wherein the oscillator circuit and the electric motor control circuit are integrated in the same integrated circuit.

12. The electronic watch according to claim 2, wherein the additional inner case is a resonator case that includes a glass cover and wherein resonator frequency of the resonator is adjusted by laser through the glass cover.

* * * * *